US011896889B2

(12) United States Patent
Stubbers et al.

(10) Patent No.: US 11,896,889 B2
(45) Date of Patent: Feb. 13, 2024

(54) HIP THRUST GUARD

(71) Applicants: David Stubbers, Carlsbad, CA (US); Christopher Maier, Chermside (AU)

(72) Inventors: David Stubbers, Carlsbad, CA (US); Christopher Maier, Chermside (AU)

( * ) Notice: Subject to any disclaimer, the term of this patent is extended or adjusted under 35 U.S.C. 154(b) by 269 days.

(21) Appl. No.: 17/531,748

(22) Filed: Nov. 20, 2021

(65) Prior Publication Data

US 2022/0161122 A1 May 26, 2022

Related U.S. Application Data

(60) Provisional application No. 63/116,449, filed on Nov. 20, 2020.

(51) Int. Cl.

| | |
|---|---|
| ***A41D 13/05*** | (2006.01) |
| ***A63B 71/12*** | (2006.01) |
| ***A63B 21/072*** | (2006.01) |

(52) U.S. Cl.

CPC ..... *A63B 71/1225* (2013.01); *A41D 13/0506* (2013.01); *A63B 21/0724* (2013.01); *A63B 2071/1233* (2013.01)

(58) Field of Classification Search

CPC .. A41D 13/0506; A41D 13/05; A41D 13/055; A41D 13/0568

See application file for complete search history.

(56) References Cited

U.S. PATENT DOCUMENTS

| | | | | |
|---|---|---|---|---|
| 9,138,613 | B2 * | 9/2015 | Ferrell | A63B 21/078 |
| 11,432,598 | B1 * | 9/2022 | Grell | A63B 71/0054 |
| 2015/0065315 | A1 * | 3/2015 | Ferrell | A63B 21/078 482/104 |
| 2017/0238625 | A1 * | 8/2017 | Lindquist | A41D 13/015 |
| 2017/0290380 | A1 * | 10/2017 | Blackmon-Humphrey | A61H 3/00 |
| 2019/0001211 | A1 * | 1/2019 | Burns | A63B 21/4035 |
| 2022/0047910 | A1 * | 2/2022 | Beck | A63B 21/0726 |

* cited by examiner

*Primary Examiner* — Katherine M Moran

(57) ABSTRACT

A hip thrust exercise guard comprising a pad, a bar insert in the pad to hold the bar of a barbell, and an adjustable band. The bar insert grips the bar of a barbell to prevent slippage during the hip thrust exercise, while still allowing slight side to side adjustments, in order to center the bar in the safest and most comfortable position. The attached adjustable band secures the pad around the hip in the optimal position for comfort, protection, and stability. The pad's soft foam construction and sculpted design contours to the hip area of the user.

14 Claims, 4 Drawing Sheets

HIP THRUST GUARD

NON-PROVISIONAL PATENT APPLICATION

This application claims priority under 35 U.S.C. § 119(e) from provisional patent Application No. 63/116,449 filed on Nov. 20, 2020. The 63/116,449 application is incorporated herein by reference.

1. FIELD OF THE INVENTION

The field of the invention is protective pads for protecting a user from injury or discomfort when lifting weight placed over the hip area. More specifically, the invention relates to a hip thrust guard that protects a user's body, pelvis, and hip bones when performing hip thrust exercises.

2. BACKGROUND OF THE INVENTION

In the hip thrust exercise, a user's upper back rests on a low bench with the feet flat on the floor and directly under the knees. A barbell is placed transversely over the hip and the user raises the hip upward, lifting the barbell. This can be painful and damaging to the hip bones, so padding is placed between the hip bones, and the barbell. But, the padding can move on the user's body and the barbell can tip and slide transversely during the exercise. The movement of the user's body during the exercise exacerbates this and injuries or bruises around the user's hip and thigh areas are not uncommon.

What is needed is a hip thrust pad that will not move and will hold the barbell in position, while protecting the exposed body parts and bones.

3. SUMMARY OF THE INVENTION

The present invention solves these problems by providing a pad with a bar insert that grips the bar of a barbell to prevent slippage, while still allowing slight side to side adjustments, in order to center the bar in the safest and most comfortable position. The pad also has an attached, adjustable band to secure the pad around the hip in the optimal position for comfort, protection, and stability. The bar insert also protects the pad material from damage by preventing the gnarled bar from shredding the pad material. The pad's soft foam construction and sculpted design contours to the hip area of the user.

The disclosed thrust guard is comprised of three main components: (1) a pad; (2) a bar insert; and (3) an adjustable band. The pad is made of high density foam designed to protect the user's hip bones and pelvis from the barbell while doing a hip thrust exercise. The bar insert is a place for the barbell to rest while the user performs a hip thrust exercise. The bar insert allows controlled movement of the barbell by the user to adjust and balance its side to side placement. The bar insert prevents the bar from moving and sliding off the user's hip during the hip thrust exercise. The bar insert also provides additional durability to the pad by preventing the knurled bar from tearing the pad's foam. The adjustable band goes around the back of the user's waist to secure the pad to the user's hip, while allowing minimal slipping during the exercise.

The invention is designed to work for glute exercises, such as the hip thrust. The invention is designed to fit any type of barbell or Smith machine.

3. BRIEF DESCRIPTION OF THE DRAWINGS

4. DETAILED OF THE INVENTION

Figure 1:
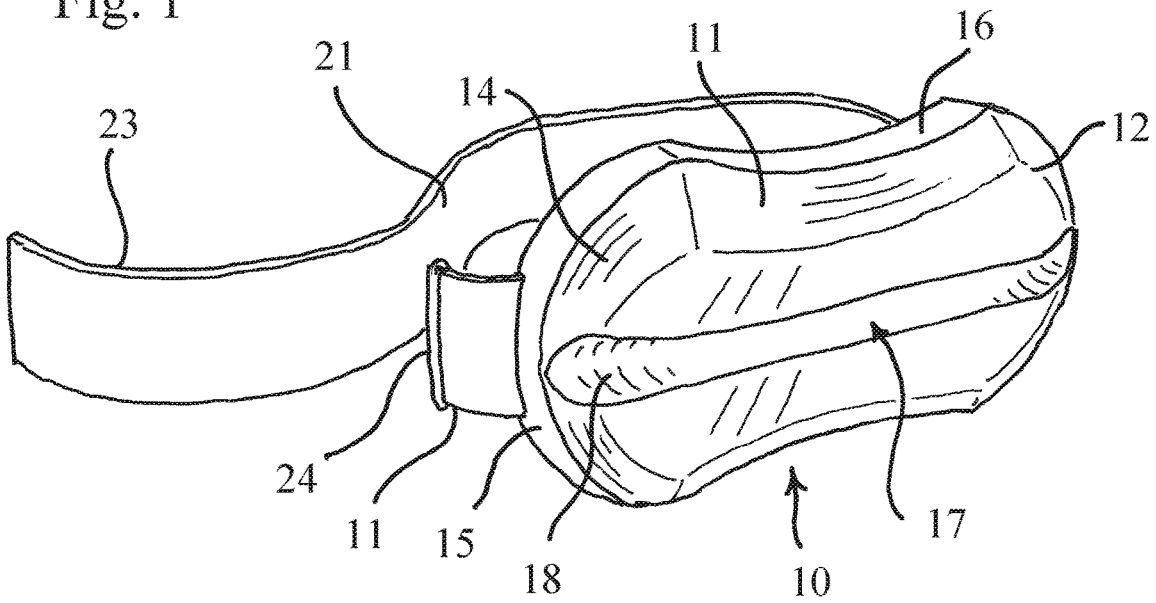
FIG. 1 is a front three-quarter perspective view of the hip thrust pad of the present invention.
Figure 2:
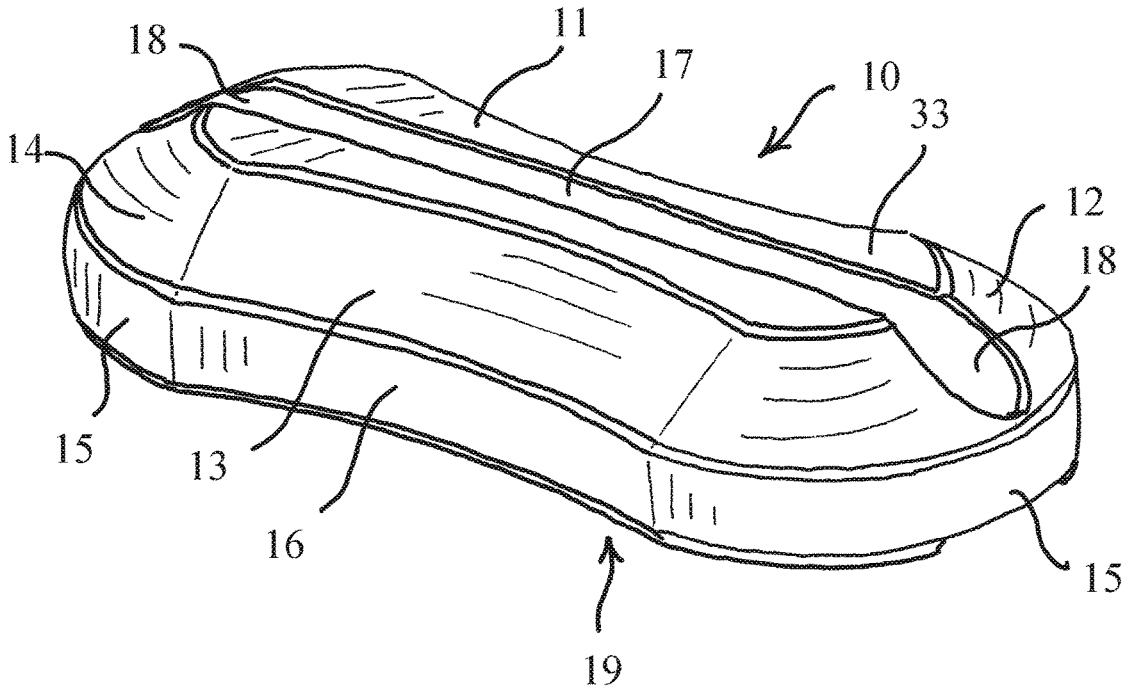
FIG. 2 is a top three-quarter perspective view of the hip thrust pad of the present invention.
Figure 3:
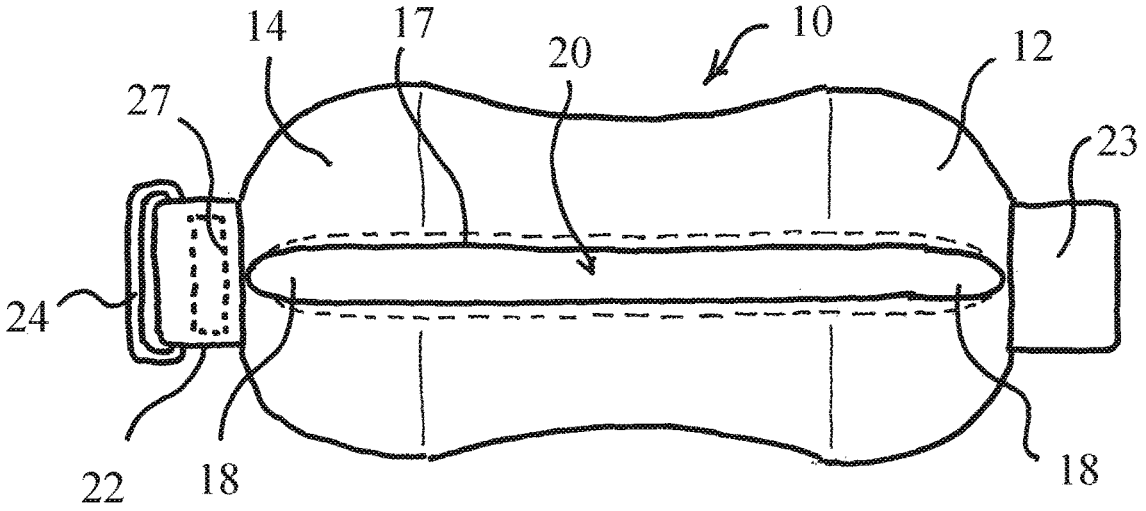
FIG. 3 is a top view of the hip thrust pad of the present invention.
Figure 4:
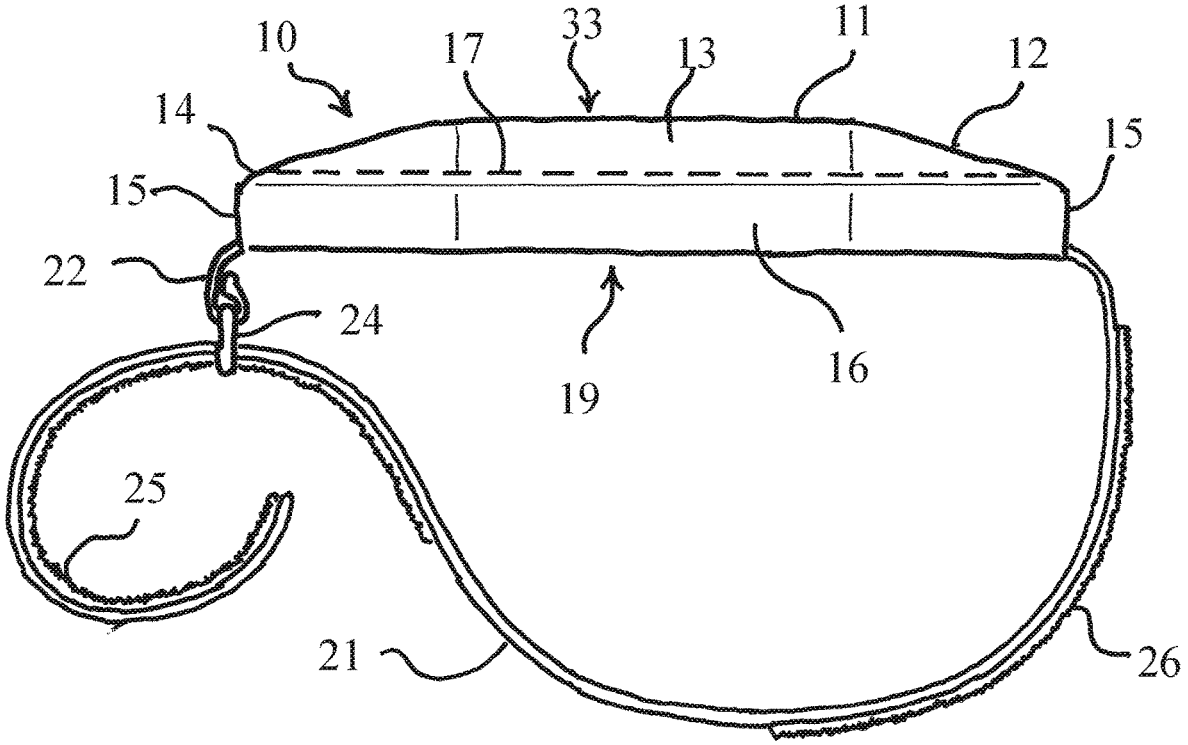
FIG. 4 is a side view of the hip thrust pad of the present invention.
Figure 5:
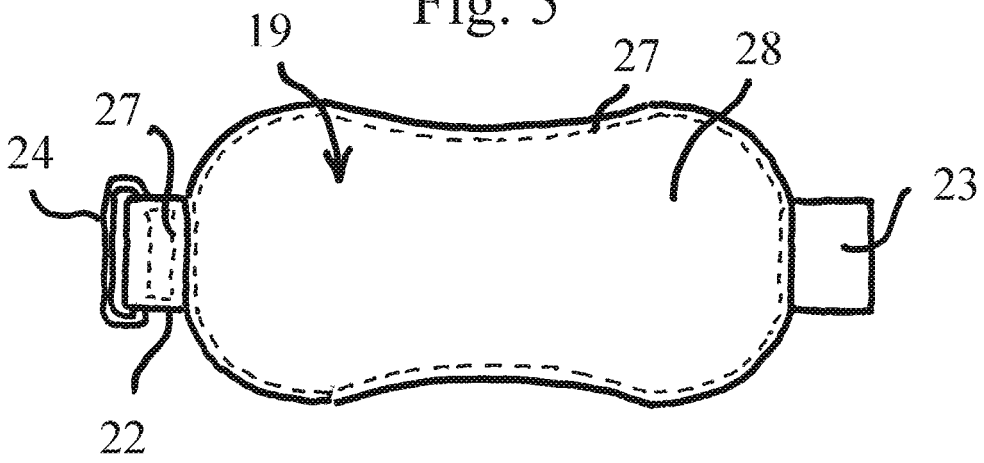
FIG. 5 is a bottom view of the hip thrust pad of the present invention with a cover in place.
Figure 6:
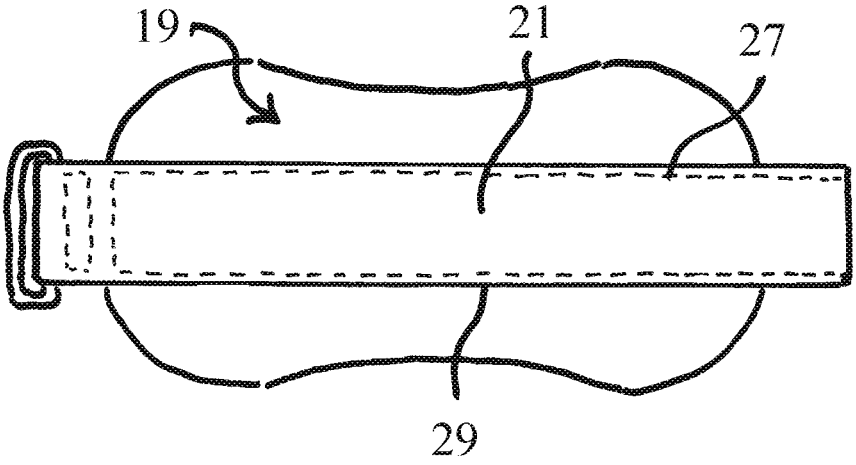
FIG. 6 is a bottom view of the hip thrust pad of the present invention with the cover removed to show the adjustable band.
Figure 7:
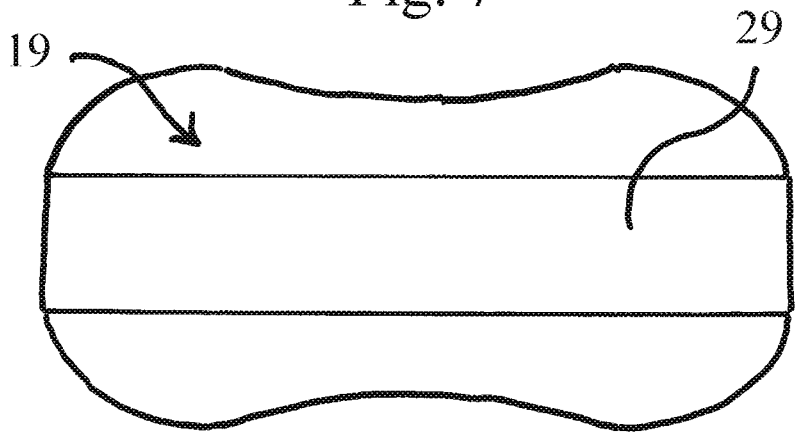
FIG. 7 is a bottom view of the hip thrust pad of the present invention with the cover and adjustable band removed to show the channel for the adjustable band.
Figure 8A:
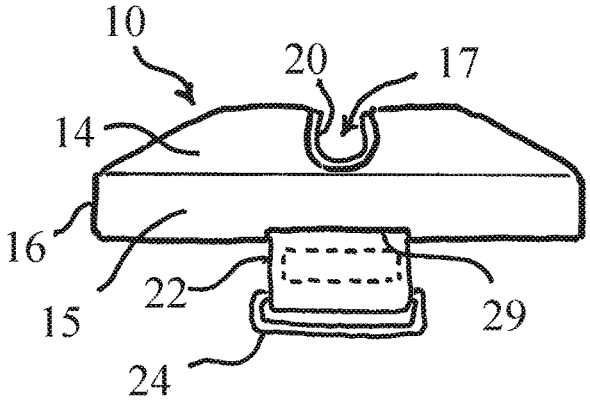
FIG. 8A is an end view of the hip thrust pad of the present invention.
Figure 8B:
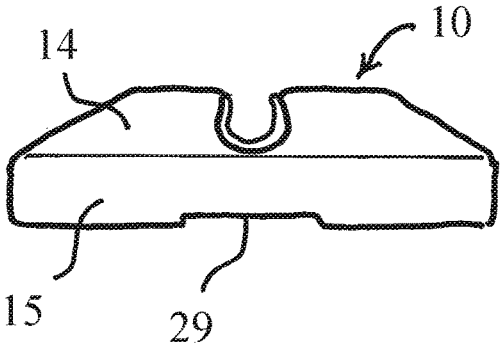
FIG. 8B is an end view of the hip thrust pad of the present invention with the adjustable band removed to show the channel for the adjustable band.

The disclosed thrust guard 10 is comprised of three main components: (1) a pad 11; (2) a bar insert 17; and (3) an adjustable band 21. The pad 11 is made of high quality and high density foam, designed to protect the user's hip bones and pelvis from the barbell, while doing a hip thrust exercise. It is thick and dense enough so that the user feels minimal discomfort from the weight loaded on the bar, and thus, the hip bones. High density expanded polypropylene (EPP) or Thermoplastic Elastomer (TPE) foam is preferred.

The pad 11 generally forms an elongated oval with rounded end walls 15 and inwardly trimmed side walls 16 walls. Above the end 15 and side 16 walls are tapered upper end walls, 14 and 15, and tapered upper side walls 13. Running longitudinally through the middle of the tapered upper end and side walls (14, 15, and 13) is a generally cylindrical, horseshoe-shaped bar insert channel 17 which is open along the length of the channel 17 at the top of the pad 11 and into which a bar 31 of a barbell (shown in FIG. 9) may be inserted through the top opening and held within the channel 17. The bar insert channel 17 is open at each end 18 of the pad 11.

Figure 9:
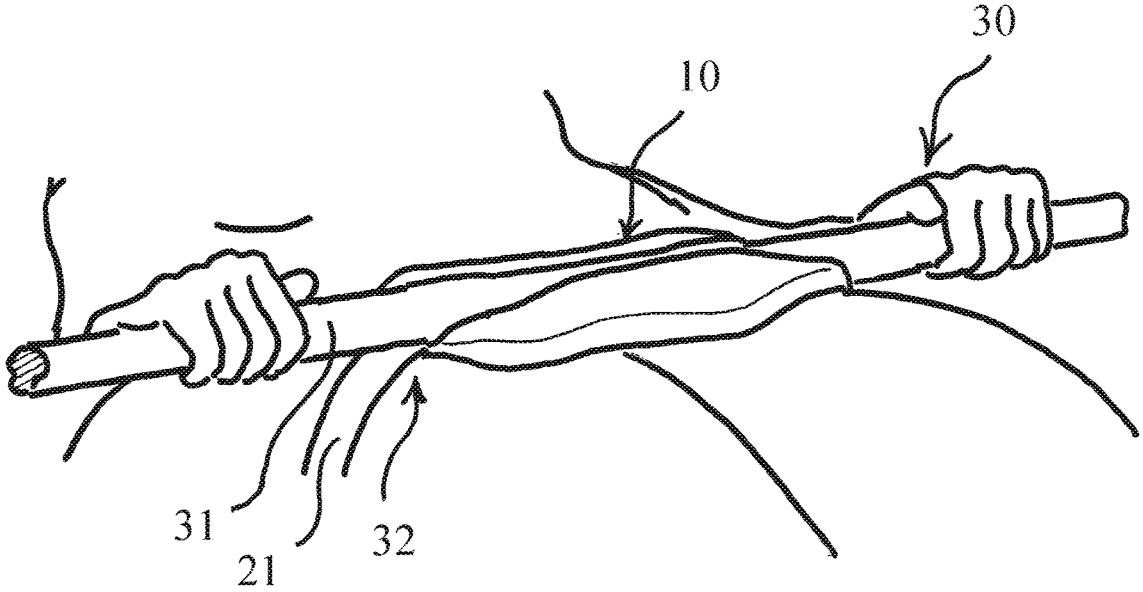
FIG. 9 shows the hip thrust pad of the present invention in use.

The bar insert channel 17 is a place for the bar 31 of a barbell to rest while the user 30 performs a hip thrust exercise, as shown in FIG. 9. A bar insert inner gripping surface 20 prevents the bar 31 from moving around on the user's body while performing the exercise. But, the bar insert inner gripping surface 20 also allows the bar 31 to slide enough so the user 30 can adjust its position easily and pinpoint the center where the barbell is balanced. If the bar 31 is off center, the bar insert inner gripping surface 20 allows the user to move the bar to either side without it detaching itself from the bar insert channel 17 and pad 11.

The foam pad 11 and bar insert inner gripping surface 20 are fit snugly around the bar 31 of an Olympic barbell. This provides grip around the bar 31, but the bar insert inner gripping surface 20 material provides enough grip to prevent the barbell from moving and sliding off the user's hip during the hip thrust exercise. The material for the bar insert inner gripping surface 20 is silicone. Kydex (U.S. Trademark Registration No. 783,815), a thermoplastic acrylic-polyvinyl chloride material, manufactured by Sekisui SPI, may be used. The silicone is inherently grippy enough to hold the bar 31 in place, such that the inside surface 20 of the bar insert inner gripping surface 20 may be smooth silicone. This allows some lateral movement of the bar 31 for adjusting the barbell's position by the user 30, yet without losing sufficient grip to prevent the barbell from sliding off the user's 30 hip 32 during the hip thrust exercise.

The adjustable band 21 is used to secure the pad 11 to the user 30. The band 21 allows for minimal slipping when performing the exercise. The adjustable band goes around the user's 30 waist and buttocks area to hold the pad 11 in place while the user 30 performs the exercise. The adjustable band 21 is secured to the bottom 19 of the pad 11. The band 21 may be bonded to the pad 11 and may also be secured with stitching 27. A channel 29 in the bottom 19 of the pad 11 may be provided so that the pad is more comfortable to the user 30. Additionally, a bottom cover 28 may also be placed over the bottom 19 of the pad 11 and band 21. At one end 14 of the pad 11, a short portion 22 of the band 21 is folded over and stitched 27 to hold a D-ring clip 24. At the opposite end 12 of the pad 11, a belt portion 23 of the band 21 has complementary hook-and-loop material ("velcro"), 25 and 26, on opposite sides of the belt portion 23, so that the belt portion 23 may be passed through the clip 24 and secured with the velcro, 25 and 26, around the user's 30 hip 32. The band 21 may be constructed from nylon and the clip 24 from plastic. Alternatively, the adjustable band 21 may be formed of an elastic fabric that may be stretched in order to place the pad 11 over the user's hip 32 and will hold the pad 11 in place.

The disclosed hip thrust exercise guard includes a hip thrust guard pad 11 defined by a top 33, bottom surface 19, oppositely disposed side walls 16, a first end wall 15 and a second end wall 15 oppositely disposed to the first end wall 15. The pad 11 has a length between the first and second end walls 15 and a pad width between the oppositely disposed side walls 16, and a height between the top 33 and the bottom surface 19. The pad 11 further comprises a bar channel 17 extending within the hip thrust guard pad 11 along the pad length between the pad width. The bar channel 17 is cylindrical and has a longitudinal top opening along the top 33 of the pad 11. The bar channel 17 has an inner surface 20 and is sized to receive a bar 31 of a barbell. A gripping surface 20 is formed on the inner surface of the bar channel 17 for frictionally gripping the bar, as described above. An adjustable band 21 is connected to the hip thrust guard pad 11. The adjustable band 21 is adapted to hold the hip thrust guard pad 11 in place over a person's 30 hips 32 during a hip thrust exercise. The hip thrust guard pad 11 is formed of a high density material, such as high density foam, such as expanded polypropylene, or thermoplastic elastomer. The gripping surface 20 may be formed of a silicone material, as described above. The adjustable band 21 may be formed by a first band segment 22 proximal to one the end walls 15 and a second band segment 23 proximal to the opposite end wall 15. A D-ring 24 may be held at the first band segment 22, and second band segment 23 can be received by the D-ring 24. Hook-and-loop (velcro) material 25 may be fixed along the distal end of the first band segment 22 and complimentary hook-and-loop material 26 may be fixed along the distal end of the second band segment 23, so that the hook-and-loop material 25 on the first band segment 22 can grip the complimentary hook-and-loop material 26 along the second band segment 23 end to hold the hip thrust guard pad 11 in place during the hip thrust exercise. A band channel 29 may be formed in the bottom surface 19 of the hip thrust guard pad 11 so that a middle segment of the band 21 will be recessed within the band channel 29 so that the adjustable band 21 not extend beyond the bottom surface 19 of the hip thrust guard pad 11. A bottom cover 28 may be disposed over the bottom surface 19 and the recessed adjustable band 21 to increase the comfort of the hip thrust guard 10 to the user 30.

The hip thrust exercise guard is also disclosed as an elongated pad 11 having a pad length between ends 15, a pad width between sides 16, a pad top surface 33, a pad bottom surface 19 oppositely disposed to the top surface 19, a pad thickness between the pad top surface 33 and the pad bottom surface 19, a horseshoe-shaped channel 17 in the elongated pad 11 extending between the first and second pad ends 15, wherein the horseshoe-shaped channel 17 has a longitudinal opening through the pad top surface 33. The horseshoe-shaped channel 17 is sized to receive a barbell 31 and further comprises a gripping surface 20 formed in the horseshoe-shaped channel 17 for frictionally engaging the barbell 31. The elongated pad 11 further comprises a strap 21 having top and bottom surfaces, a first strap end 22, and a second strap end 23. The strap 21 top surface is joined to the bottom surface 19 of the pad 11 and the first strap end 22 extends from the first pad end 15 and the second strap end 23 extends from the second pad end 15. The first strap end 22 terminates in a D-ring 24. A portion of the strap 23 extending from the second pad end 15 has a velcro material 26 disposed on the strap 21 top surface and another portion of the strap 21 a complimentary material 25 disposed on the top strap surface, so that the strap 21 is adapted to extend about a waist of a person 30 and hold the elongated pad 11 over a hip 32 of the person 30. The pad length, pad width and pad thickness of the elongated pad 11 are adapted to provide padding of the hip 32 during a hip thrust exercise. The elongated pad 11 may be formed of a high density material, such as expanded polypropylene or thermoplastic elastomer. The gripping surface 20 may be a silicone material. The pad bottom surface 19 may include a recessed strap channel 29 into which the strap 21 top surface may be joined to the pad bottom surface 19, so as to increase comfort to the user 30. A cover 28 may be added over the pad bottom surface 19 and the strap 21, so as to further increase comfort.

The hip thrust guard 10 is designed to work for glute exercises, such as the hip thrust. The invention is designed to fit any type of barbell or Smith machine.

To use hip thrust guard 10, the user 30:

1. Unstraps the velcro 25 at the belt end 23 of the adjustable band 21.
2. Sits on the ground with knees bent.
3. With the velcro 25 loosened, slides the hip thrust guard 10 over the knees up to the pelvis area 32, making sure the bar insert 17 is centered directly above the hip bones 32.
4. Tightens the adjustable band 21 around the back and over the waist or buttocks area 32, then attaches the complimentary velcro pieces, 25 and 26, together after finding desired tension.
5. While on the floor, positions the shoulders and shoulder blades against the bench or foam box.
6. Rolls the barbell over the legs until the bar 31 is directly over the hips 32.
7. Places the bar 31 in the bar insert channel 17 of the pad 11 and adjusts the position of the bar 31 to center it over the hips 32.
8. Places elbows on the platform and hands on the bar 31 to steady it.

The drawings and description set forth here represent only some embodiments of the invention. After considering these, skilled persons will understand that there are many ways to make a hip thrust guard according to the principles disclosed. The inventor contemplates that the use of alternative structures, materials, or manufacturing techniques, which result in a hip thrust guard according to the principles disclosed, will be within the scope of the invention.

The invention claimed is:

1. A hip thrust guard comprising:

a hip thrust guard pad defined by a top, bottom surface, oppositely disposed side walls, a first end wall, and a second end wall oppositely disposed to the first end wall, said hip thrust guard pad having a pad length between the first and second end walls, a pad width between the oppositely disposed side walls, and a height between the top and the bottom surface, wherein the hip thrust guard pad further comprises a bar channel extending within the hip thrust guard pad along the pad length between the pad width, wherein the bar channel is cylindrical and has a longitudinal top opening along the top of the hip thrust guard pad, and wherein the bar channel has an inner surface and is sized to receive a bar of a barbell, a gripping surface formed on the inner surface of the bar channel for frictionally gripping the bar, and an adjustable band connected to the hip thrust guard pad, wherein the adjustable band is adapted to hold the hip thrust guard pad in place over a person's hips during a hip thrust exercise.

2. The hip thrust guard of claim 1, wherein the hip thrust guard pad is formed of a high density foam material.

3. The hip thrust guard of claim 1, wherein the hip thrust guard pad is formed of a high density material selected from the group consisting of expanded polypropylene and thermoplastic elastomer.

4. The hip thrust guard of claim 1, wherein the gripping surface is formed of a silicone material.

5. The hip thrust guard of claim 1, wherein the adjustable band further comprises a first band segment having a first band proximal end connected to the first end wall of the hip thrust guard pad and an oppositely disposed first band distal end, and a second band segment having a second band proximal end connected to a second end wall of the hip thrust guard pad and an oppositely disposed second band distal end, wherein, and wherein a D-ring is held at the first band distal end, and wherein the second band distal end is received by the D-ring.

6. The hip thrust guard of claim 5, further comprising a hook-and-loop material fixed along the first band distal end and a complimentary hook-and-loop material fixed along the second band distal end, wherein the hook-and-loop material along the first band distal end grips the complimentary hook-and-loop material along the second band distal end to hold the hip thrust guard pad in place during the hip thrust exercise.

7. The hip thrust guard of claim 6, further comprising a band channel formed in the bottom surface of the hip thrust guard pad along the pad length, wherein the adjustable band further comprises a middle band segment between the first band proximal end and the second band proximal end, and wherein the band channel is sized so that the adjustable band will not extend beyond the bottom surface of the hip thrust guard pad.

8. The hip thrust guard of claim 6, further comprising a bottom cover disposed over the bottom surface of the hip thrust guard pad and middle band segment of the adjustable band.

9. A hip thrust exercise guard, comprising an elongated pad having a pad length, a pad width, a pad top surface, a pad bottom surface oppositely disposed to the pad top surface, a pad thickness between the pad top surface and the pad bottom surface, a first pad end and a second pad end, wherein the first pad end and second pad end are at opposite ends of the pad length, a horseshoe-shaped channel in the elongated pad extending between the first pad end and second pad end, wherein the horseshoe-shaped channel has a longitudinal opening through the pad top surface and wherein the horseshoe-shaped channel is sized to receive a barbell and further comprises a gripping surface formed in the horseshoe-shaped channel for frictionally engaging the barbell, wherein the elongated pad further comprises a strap having a first strap end, a second strap end, a strap top surface, wherein the strap top surface is joined to the pad bottom surface and the first strap end extends from the first pad end and the second strap end extends from the second pad end, wherein the first strap end terminates in a D-ring, and wherein a portion of the strap extending from the second pad end has a hook and loop material disposed on the strap top surface and another portion of the strap at the second strap end has a complimentary hook and loop material disposed on the strap top surface, wherein the strap is adapted to extend about a waist of a person and hold the elongated pad over a hip of the person, and wherein the pad length, pad width and pad thickness of the elongated pad are adapted to provide padding of the hip during a hip thrust exercise.

10. The hip thrust exercise guard of claim 9, wherein the elongated pad is formed of a high density foam material.

11. The hip thrust exercise guard of claim 9, wherein the elongated pad is formed of a material selected from the group consisting of expanded polypropylene and thermoplastic elastomer.

12. The hip thrust exercise guard of claim 9, wherein the gripping surface is a silicone material.

13. The hip thrust exercise guard of claim 9, wherein the pad bottom surface further comprises a recessed strap channel and the strap top surface is joined to the pad bottom surface within the recessed strap channel.

14. The hip thrust exercise guard of claim 13, further comprising a cover over the pad bottom surface and the strap.

* * * * *